US009890581B2

(12) United States Patent
Jeong

(10) Patent No.: US 9,890,581 B2
(45) Date of Patent: Feb. 13, 2018

(54) SELF-ASSEMBLY SAFETY DOOR

(71) Applicant: Tae Young Jeong, Incheon (KR)

(72) Inventor: Tae Young Jeong, Incheon (KR)

( * ) Notice: Subject to any disclaimer, the term of this patent is extended or adjusted under 35 U.S.C. 154(b) by 0 days.

(21) Appl. No.: 15/101,908

(22) PCT Filed: Dec. 2, 2014

(86) PCT No.: PCT/KR2014/011695

§ 371 (c)(1),
(2) Date: Jun. 4, 2016

(87) PCT Pub. No.: WO2015/084019

PCT Pub. Date: Jun. 11, 2015

(65) Prior Publication Data

US 2016/0369554 A1 Dec. 22, 2016

(30) Foreign Application Priority Data

Dec. 6, 2013 (KR) ..... 10-2013-0151334

(51) Int. Cl.

| | |
|---|---|
| ***E06B 7/36*** | (2006.01) |
| ***E06B 1/52*** | (2006.01) |
| ***E06B 5/10*** | (2006.01) |
| ***E06B 1/08*** | (2006.01) |

(Continued)

(52) U.S. Cl.

CPC ..... *E06B 7/36* (2013.01); *E06B 1/08* (2013.01); *E06B 1/52* (2013.01); *E06B 3/7003* (2013.01); *E06B 5/10* (2013.01); *E06B 1/30* (2013.01)

(58) Field of Classification Search

CPC ..... E06B 7/362; E06B 2007/365; E05D 11/0018; E05D 11/0027

See application file for complete search history.

(56) References Cited

U.S. PATENT DOCUMENTS 1,484,024 A * 2/1924 Hedman ..... E06B 7/362 49/384
2,184,259 A * 12/1939 Seaman ..... E06B 7/362 16/224

(Continued)

FOREIGN PATENT DOCUMENTS

GB 2 276 187 A 9/1994
JP H10-169319 A 6/1998

(Continued)

OTHER PUBLICATIONS

European Search Report dated Jul. 5, 2017.
Extended European Search Report dated Oct. 13, 2017 as received in Application No. 14868172.9.

*Primary Examiner* — Katherine W Mitchell
*Assistant Examiner* — Catherine A Kelly
(74) *Attorney, Agent, or Firm* — Maschoff Brennan

(57) ABSTRACT

The present invention provides a self-assembly safety door comprising: a doorpost coupled and fixed to both sides of a temporary doorframe formed on a distal end of a wall body; a door provided on the doorpost to horizontally rotate so as to be selectively opened/closed; a corner part provided on one end part of the door to be coupled to the door and hinge-coupled to the doorpost to rotate with the door at the same time; and a coupling part interposed between the door and the corner part to couple the door and the corner part.

3 Claims, 5 Drawing Sheets

(51) Int. Cl.
*E06B 3/70* (2006.01)
*E06B 1/30* (2006.01)

(56) References Cited

U.S. PATENT DOCUMENTS 2,557,716 A * 6/1951 Allee ..... E05D 5/06 16/250
3,934,371 A * 1/1976 Ulatowski ..... E06B 7/362 49/383
4,290,233 A * 9/1981 Hubbard ..... E06B 7/362 49/383
4,845,892 A * 7/1989 Pinto ..... E06B 7/16 49/383
6,311,432 B1 * 11/2001 Watson ..... E06B 7/362 49/383
6,449,802 B2 * 9/2002 Maeda ..... E05D 5/06 16/225
8,453,384 B2 * 6/2013 Boyer ..... E06B 7/36 49/383
8,567,879 B2 * 10/2013 Carter ..... A47F 5/08 248/188.5
8,656,642 B2 * 2/2014 Boens ..... E06B 7/36 49/170
2009/0288269 A1 * 11/2009 Ross ..... A47K 3/36 16/82
2010/0313484 A1 * 12/2010 Boyer ..... E06B 7/36 49/399
2015/0121766 A1 * 5/2015 Jeong ..... E06B 7/36 49/462

FOREIGN PATENT DOCUMENTS

JP 2000-213243 A 8/2000
KR 10-0388543 B1 6/2003
KR 10-2009-0045636 A 5/2009
KR 10-1010758 B1 1/2011
KR 10-1213121 B1 12/2012
WO 2007/020424 A1 2/2007
WO 2008/108513 A1 9/2008

* cited by examiner

[Fig. 3]

[Fig. 5]
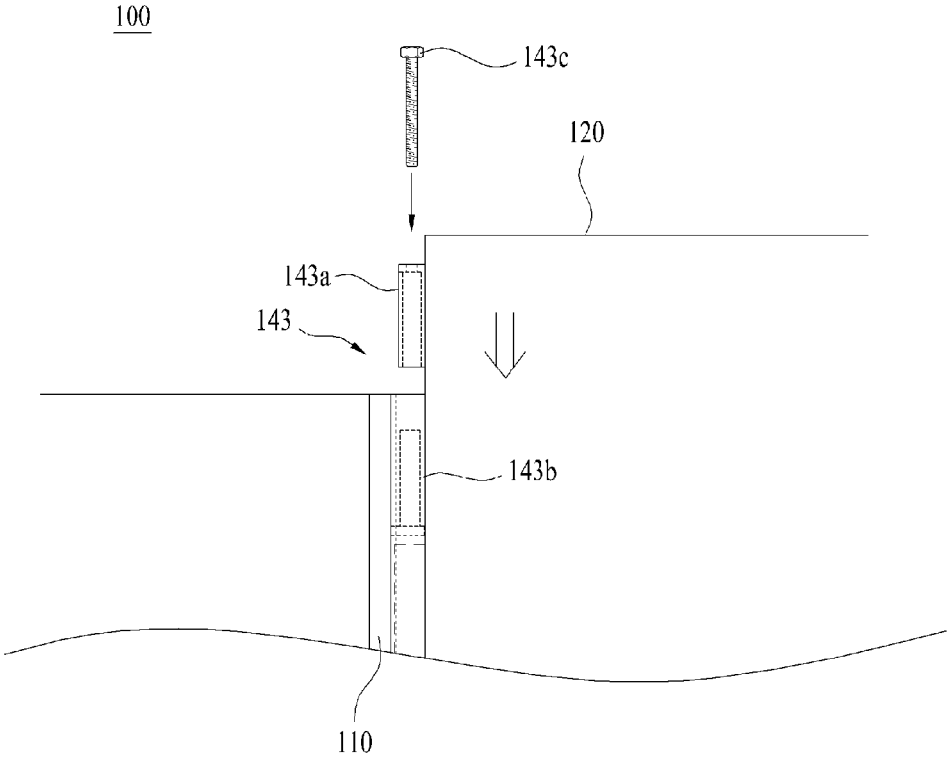

SELF-ASSEMBLY SAFETY DOOR

TECHNICAL FIELD

The present invention relates to a self-assembly safety door, and particularly to a self-assembly safety door which is manufactured by assembling a door and a corner part formed on the side end of the door.

BACKGROUND ART

In general, doors are made of steel or wood and function to separate a space from another space so as to independently define the spaces.

A steel door is typically disposed in an exterior space to serve as an entrance door such as a front door and for the purpose of crime prevention, and a wooden door is typically disposed between a space and another space in order to partition an interior space.

Here, the wooden door functions to selectively cover a gap between a doorpost and a doorframe coupled with a threshold between wall bodies in the interior space, and typically includes a sliding door, a hinged door, or the like.

However, since the conventional interior hinged door has a hinge structure in which the doorpost is coupled to the door by hinges, a gap is formed between the doorpost and the door when the door is opened, and the gap is eliminated when the door is closed again. For this reason, a safety accident may occur when a portion of a user's body is caught in the gap.

In addition, due to this problem, there is a limitation as to the ability to simultaneously and integrally transport, load, and treat parts to be processed and unnecessary processing parts in the door when the door is manufactured.

DISCLOSURE

Technical Problem

The present invention has been made in view of the above problems, and it is an object of the present invention to provide a self-assembly safety door which is manufactured by separately processing and assembling a door and a corner part formed on the side end of the door.

Technical Solution

The object of the present invention can be achieved by providing a self-assembly safety door which includes a doorpost fixedly coupled to opposite sides of temporary doorframes formed at tips of wall bodies, a door provided on the doorpost so as to be opened and closed by horizontal rotation, a corner part provided on one end of the door to be coupled to the door, the corner part being coupled to the doorpost by a hinge to rotate along with the door, and a coupling part interposed between the door and the corner part to couple the door and the corner part.

The coupling part may include a fixing member provided at one selected end of the door or the corner part in a longitudinal direction thereof, and a slit groove formed in the other end of the door or the corner part provided with the fixing member such that the fixing member is slidably coupled into the slit groove.

The coupling part may include a first connector for connecting one upper end of the door to one upper end of the corner part, and a second connector for connecting one lower end of the door to one lower end of the corner part.

The first connector may include a first female connector connected to the upper end of the door, a first male connector connected to the upper end of the corner part, and a first fastener to penetrate and couple the first female connector and the first male connector, and the second connector may include a second male connector connected to the lower end of the door, a second female connector connected to the lower end of the corner part, and a second fastener to penetrate and couple the second female connector and the second male connector.

The first female connector and the second male connector may be disposed on the ends of the door so as to be spaced apart from both ends of the fixing member by a predetermined distance.

The doorpost may include a first frame to which the corner part is rotatably coupled by a hinge, and a second frame arranged in parallel with the first frame while facing the first frame so as to come into contact with the door when the door is closed.

The first frame may include a first doorframe coupled to one of the temporary doorframes and having a safety groove formed such that a portion or an entirety of the corner part is selectively inserted into the safety groove during rotation, the first doorframe being elongated in a longitudinal direction of the temporary doorframe, and a second doorframe disposed adjacent to the first doorframe, and coupled to the temporary doorframe so as to have a variable width varying according to a thickness of the temporary doorframe.

The second frame may include a third doorframe coupled to the other one of the temporary doorframes and facing the door when the door is closed, and a fourth doorframe disposed adjacent to the third doorframe, and coupled to the other temporary doorframe so as to have a variable width varying according to a thickness of the other temporary doorframe.

Advantageous Effects

A self-assembly safety door according to the present invention can have the following effects.

First, since a corner part and a door are processed separately, the processing of the safety door can be facilitated.

Secondly, the safety door can be easily manufactured according to the size of the door, and can have improved interchangeability.

Thirdly, since no gap is formed between a doorpost and the door, it is possible to prevent a safety accident caused when a portion of a user's body is caught in the gap.

Fourthly, since the doorpost is separately processed, the safety door can be constructed corresponding to the thickness of a wall body or the size of the door.

Fifthly, since the components of the safety door are simply assembled in a factory or on the site, it is possible to reduce the construction period and costs.

DESCRIPTION OF DRAWINGS

FIG. 5 is a reference view illustrating a state in which the self-assembly safety door of FIG. 2 is assembled.

BEST MODE

Reference will now be made in detail to the exemplary embodiments of the present invention, examples of which are illustrated in the accompanying drawings. Prior to the description, it is noted that the terms and words used in the present specification and claims should not be construed as being limited to common or dictionary meanings but instead should be understood to have meanings and concepts in agreement with the spirit of the present invention based on the principle that an inventor can define the concept of each term suitably in order to describe his/her own invention in the best way possible.

Figure 1:
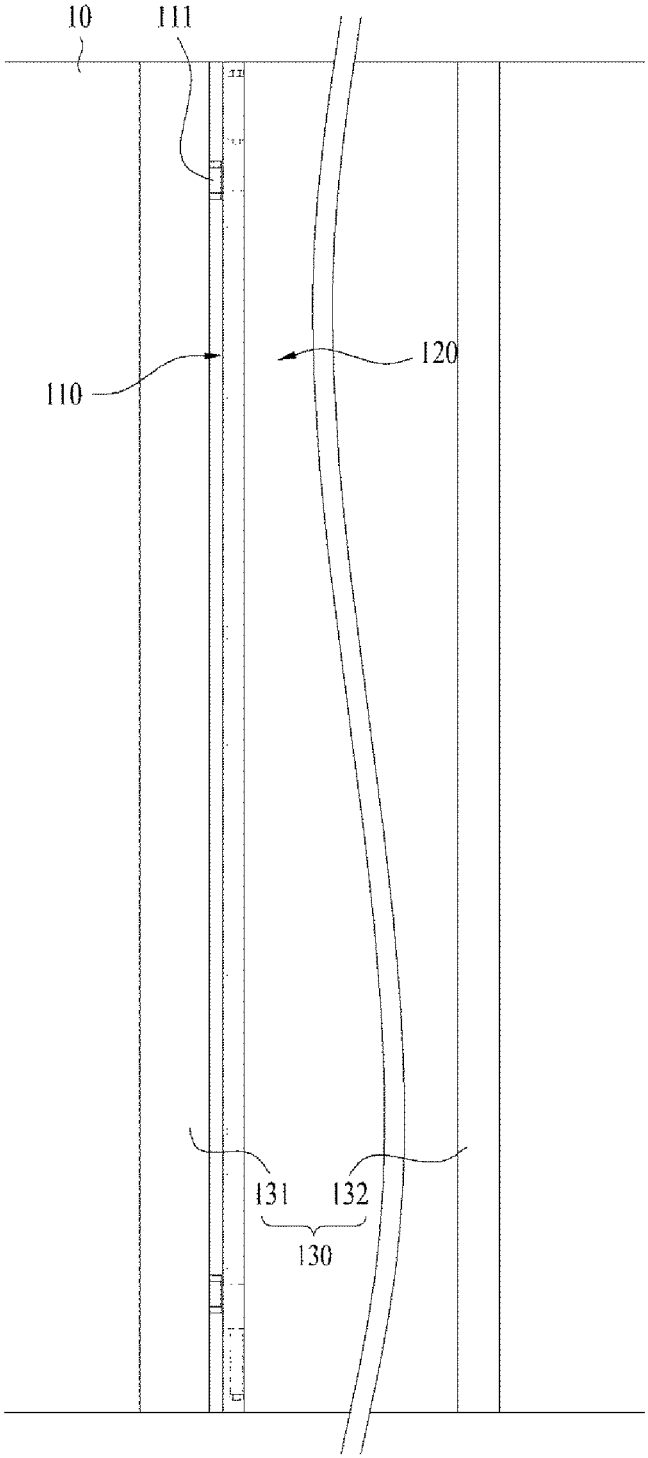
FIG. 1 is a front view illustrating a self-assembly safety door according to an embodiment of the present invention.
Figure 2:
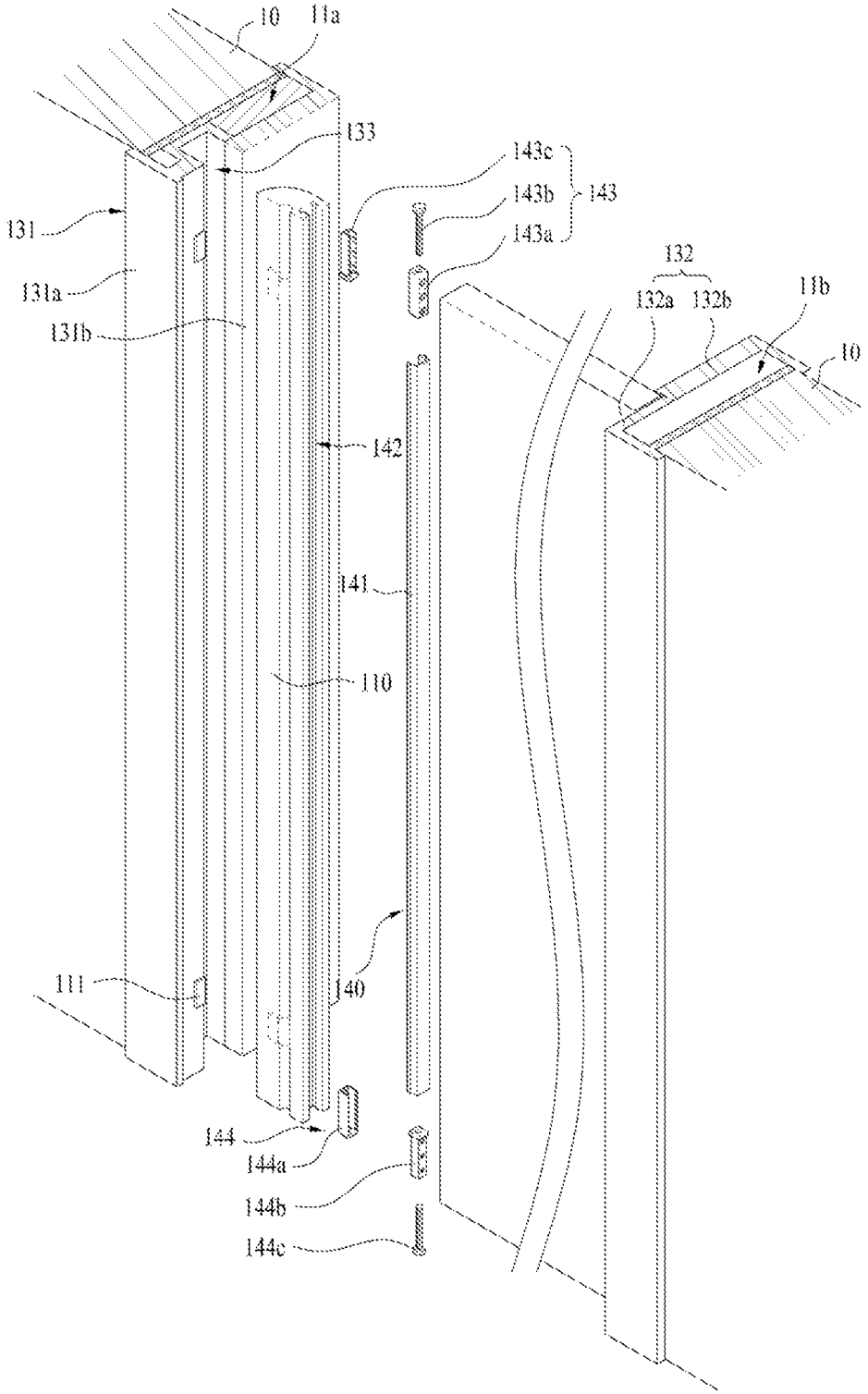
FIG. 2 is an exploded perspective view illustrating the self-assembly safety door of FIG. 1.
Figure 3:
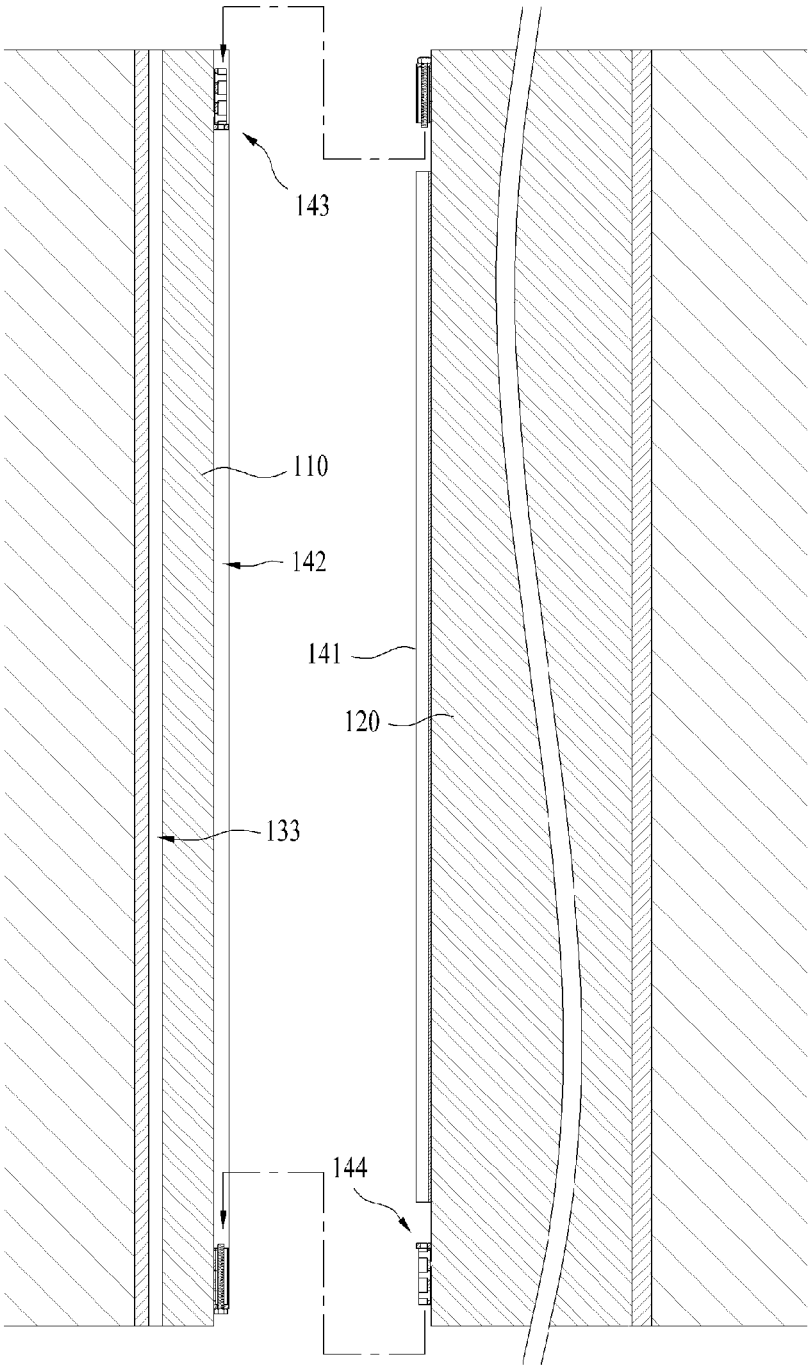
FIG. 3 is a cross-sectional view illustrating a state in which the self-assembly safety door of FIG. 2 is separated on the plane.

FIG. 1 is a front view illustrating a self-assembly safety door 100 according to an embodiment of the present invention. FIG. 2 is an exploded perspective view illustrating the self-assembly safety door 100 of FIG. 1. FIG. 3 is a cross-sectional view illustrating a state in which the self-assembly safety door 100 of FIG. 2 is separated on the plane.

Referring to FIGS. 1 to 3, the self-assembly safety door 100 according to the embodiment of the present invention includes a doorpost 130 which is coupled to temporary doorframes 11*a* and 11*b* formed on the tips of wall bodies 10, a corner part 110 which is coupled to the doorpost 130, a door 120 which is coupled to the corner part 110 so as to be opened and closed by horizontal rotation, and a coupling part 140 which couples the corner part 110 to the door 120.

The doorpost 130 is a type of pillar which is vertically constructed at the opposite inner sides of the temporary doorframes 11*a* and 11*b*, and the corner part 110 is rotatably coupled into the doorpost 130 by a hinge 111.

The doorpost 130 includes a first frame 131 to which the corner part 110 is rotatably coupled by the hinge, and a second frame 132 which is vertically arranged in parallel with the first frame 131 while facing the first frame 131, so as to come into contact with the door 120 when the door 120 is closed.

Each of the first and second frames 131 and 132 is longitudinally formed by injection or extrusion molding. The first frame 131 has a safety groove 133 formed such that a portion or the entirety of the corner part 110 may be selectively inserted into the safety groove 133 during rotation. In this case, the safety groove 133 is preferably formed in the longitudinal direction of the first frame 131 in such a manner that the cross-section of the first frame 131 is bent many times.

Accordingly, the doorpost 130 may be easily manufactured to match the dimensions of the temporary doorframes 11*a* and 11*b*, and may be manufactured corresponding to temporary doorframes having various sizes or doors having various shapes. Therefore, it is possible to reduce manufacturing costs and the construction period.

The safety groove 133 formed in the doorpost 130 is formed in a vertical direction which is the longitudinal direction of the doorpost 130, and functions to prevent safety accidents such as injuries caused when a portion of a user's body is caught by the insertion of the corner part 110 when the door 120 is closed.

As illustrated in FIG. 2, the corner part 110 is coupled to the doorpost 130 by the hinge 111.

The coupling part 140 is interposed between the corner part 110 and the door 120 and fastens the corner part 110 to the door 120.

The coupling part 140 includes a fixing member 141 which is fastened to one end of the door 120, a slit groove 142 which is longitudinally formed in one end of the corner part 110 so that the fixing member 141 is slidably coupled into the slit groove 142, a first connector 143 which connects upper ends between the corner part 110 and the door 120, and a second connector 144 which connects lower ends between the corner part 110 and the door 120.

Both ends of the fixing member 141 longitudinally protrude from one end of the door 120, and the fixing member 141 is slidably coupled along the slit groove 142. The fixing member 141 may be tightly fitted into the slit groove 142 if necessary. For example, the fixing member 141 may have a "⊏" shape in a cross-section thereof to form a void therein in the longitudinal direction thereof. Preferably, the void has a size sufficiently large to receive the first or second connector 143 or 144.

Here, the first connector 143 includes a first female connector 143*a* connected to the upper end of the door 120, a first male connector 143*b* connected to the upper end of the corner part 110, and a first fastener 143*c* which penetrates and couples the first female connector 143*a* and the first male connector 143*b*.

In addition, the second connector 144 includes a second male connector 144*b* connected to the lower end of the door 120, a second female connector 144*a* connected to the lower end of the corner part 110, and a second fastener 144*c* which penetrates and couples the second male connector 144*b* and the second female connector 144*a*.

In this case, the first female connector 143*a* and the second male connector 144*b* are respectively disposed on the ends of the door 120 so as to be opened upward from the upper and lower ends of the door 120, and the first male connector 143*b* and the second female connector 144*b* are respectively disposed on the ends of the corner part 110 so as to be opened downward from the upper and lower ends of the corner part 110.

This allows the first female connector 143*a* and the first male connector 143*b* to face each other in the opening directions thereof when they are slidably coupled to each other, and the second female connector 144*a* and the second male connector 144*b* are disposed to face each other in the opening directions thereof for the same reason. Here, the expression "opening directions" refers to a direction in which one is opened and a direction in which the other is closed, and the first female and male connectors 143*a* and 143*b* or the second female and male connector 144*a* and 144*b* are disposed so as to be fastened by the first fastener 143*c* or the second fastener 144*c* in the closing directions thereof.

Then, the coupling of the corner part 110 and the door 120 is completed. The corner part 110 rotates along with the door 120. Although not illustrated in the drawings, an additional component, such as acoustic insulation, damp-proof material, or thermal insulation, may be provided between the coupling surfaces of the corner part 110 and the door 120.

Accordingly, since the corner part 110 and the door 120 may be processed separately, the processing of the self-assembly safety door 100 can be facilitated and it is possible to reduce the production period and costs.

Hereinafter, the assembly method and operation of the self-assembly safety door 100 according to the embodiment of the present invention will be described in detail. Throughout the following description, reference numerals similar to the above reference numerals refer to like parts.

Figure 4:
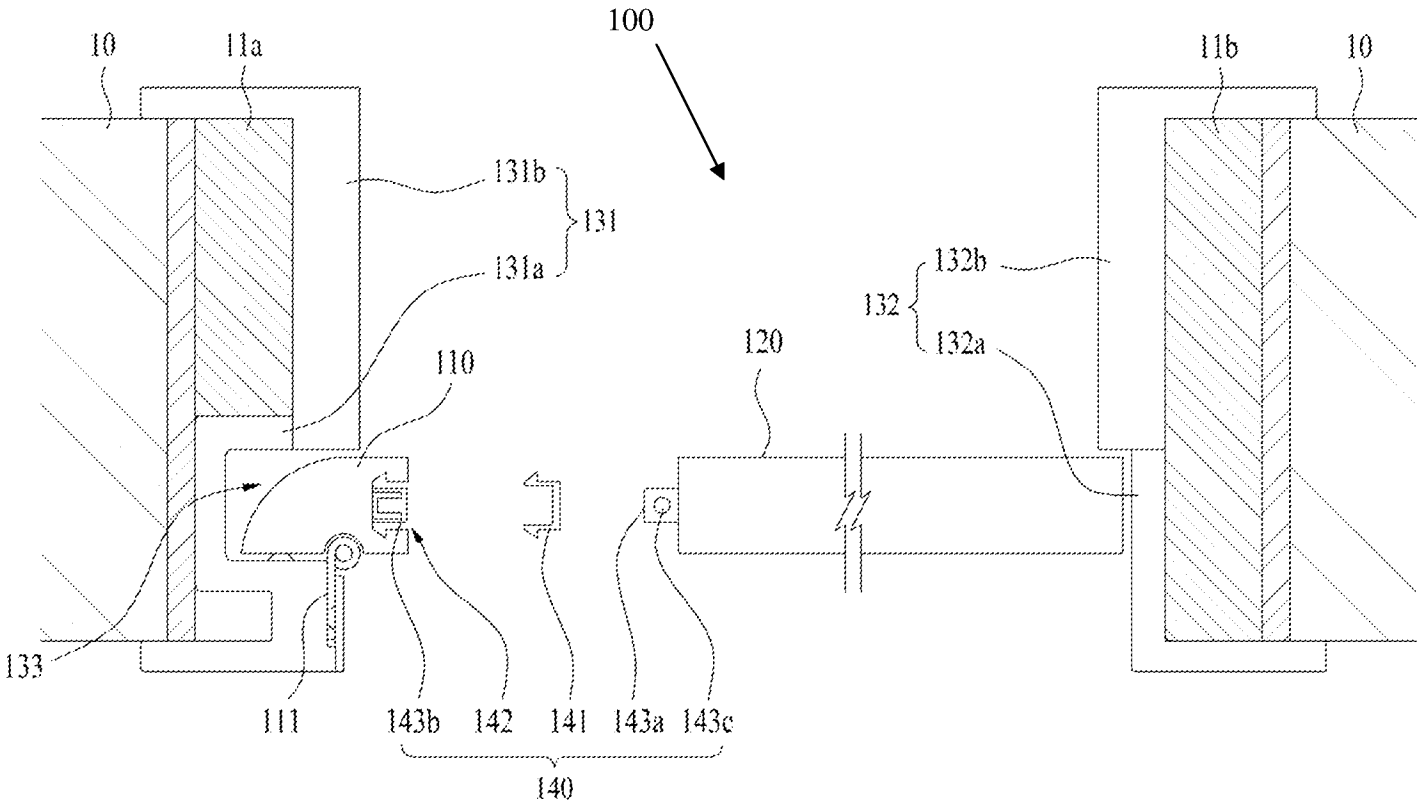
FIG. 4 is a front cross-sectional view illustrating the self-assembly safety door of FIG. 2.

FIG. 4 is a front cross-sectional view illustrating the self-assembly safety door 100 and the doorpost 130 of FIG.

2. FIG. 5 is a reference view illustrating a state in which the self-assembly safety door 100 of FIG. 2 is assembled.

Referring to FIGS. 4 and 5, the corner part 100 and the door 120 are assembled in a sliding manner and are fastened through the coupling of the first and second connectors 143 and 144.

In order for the corner part 100 and the door 120 to be fastened in a sliding manner, the fixing member 141 is first coupled at the center of one end of the door 120, and is slidably coupled into the slit groove 142 formed in the corner part 110.

Here, the fixing member 141 and the slit groove 142 serve to guide the sliding directions of the corner part 110 and the door 120 for the coupling thereof, and to simultaneously set the sliding-coupling positions of the first and second connectors 143 and 144.

When the fixing member 141 is slidably coupled into the slit groove 142, the first male connector 143*b* is coupled to one upper end of the corner part 110, and the first female connector 143*a* is coupled to one lower end of the door 120.

In this case, the coupling position of each of the first and second connectors 143 and 144 is clearly set by a positioning tool (not shown) for positioning the first or second connector 143 or 144 on the corner part 110 or the door 120. Therefore, the first and second connectors 143 and 144 may be easily bolted at positions specified by the positioning tool without calculating precise dimensions or angles.

When the fastening of the first male connector 143*b* and the second male connector 144*b* is completed, the corner part 110 and the door 120 slide in order to respectively fasten the first female connector 143*a* and the second female connector 144*a* to the other sides of the first male connector 143*b* and the second male connector 144*b*.

As illustrated in FIG. 5, the corner part 110 and the door 120 slide so as to have different heights, and the first female connector 143*a* is coupled to one upper end of the door 120. In addition, although not illustrated in the drawing, the second female connector 144*a* is coupled to one lower end of the corner part 110.

In this case, the first female connector 143*a* and the second male connector 144*b* are preferably disposed on the ends of the door 120 so as to be spaced apart from both ends of the fixing member 141 by a predetermined distance. Here, the predetermined distance corresponds to the length of the first female connector 143*a* or the second male connector 144*b*, thereby enabling the first or second connector 143 or 144 to be easily assembled. Of course, the first female connector 143*a* and the second male connector 144*b* may be disposed adjacent to both ends of the fixing member 141.

When the fastening of the first female connector 143*a* and the second female connector 144*a* is completed, the door 120 slides downward on the corner part 110. Thus, the first connector 143 is coupled to the second connector 144, and the first and second fasteners 143*c* and 144*c* are respectively fastened to the first connector 143 and the second connector 144, so that the assembly of the safety door is completed.

As such, since the corner part 110 and the door 120 may be processed separately, the processing of the self-assembly safety door 100 of the present invention can be facilitated. In addition, the self-assembly safety door 100 can be easily manufactured according to the size of the door 120, and can have improved interchangeability. Moreover, since the components of the self-assembly safety door 100 are simply assembled on the site, it is possible to reduce the construction period and costs.

The doorpost 130 includes the first frame 131 and the second frame 132.

Here, the first frame 131 includes a first doorframe 131*a* which is coupled to one temporary doorframe 11*a* and has a safety groove 133 formed such that a portion or the entirety of the corner part 110 may be selectively inserted into the safety groove 133 during rotation, and a second doorframe 131*b* which is adjacent to the first doorframe 131*a* and is coupled to the temporary doorframe 11*a*.

In addition, the second frame 132 includes a third doorframe 132*a* which is coupled to the other temporary doorframe 11*b* and faces the door when the door is closed, and a fourth doorframe 132*b* which is adjacent to the third doorframe 132*a* and is coupled to the other temporary doorframe 11*b* such that the width of the fourth doorframe varies according to the thickness of the other temporary doorframe 11*b*. Of course, the first frame 131 may be fixed to the tip of the wall body that includes one temporary doorframe 11*a*, and the second frame 132 may be fixed to the tip of the wall body that includes the other temporary doorframe 11*b*.

Preferably, each of the temporary doorframes 11*a* and 11*b* is made of wood or synthetic resin, and the first and second frames 131 and 132 are coupled by tacker pins or pieces.

In this case, the second and fourth doorframes 131*b* and 132*b* are provided such that the respective widths thereof may be variably adjusted corresponding to the thicknesses of one temporary doorframe 11*a* and the other temporary doorframe 11*b*. For example, the second and fourth doorframes 131*b* and 132*b* have a structure in which the portions of the second and fourth doorframes 131*b* and 132*b* adjacent to the respective first and third doorframes 131*a* and 132*a* when the second and fourth doorframes 131*b* and 132*b* are manufactured may have lengths corresponding to the widths of the temporary doorframes 11*a* and 11*b*, and the portions may be cut or separated according to the widths of the temporary doorframes 11*a* and 11*b* to be constructed.

Accordingly, in the self-assembly safety door 100 of the present invention, the doorpost can be easily installed on the temporary doorframes provided at the tips of the wall bodies.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

Since a corner part and a door are separately processed, the processing of a self-assembly safety door according to the present invention can be facilitated and the self-assembly safety door can have improved interchangeability. In addition, the supply of self-assembly safety doors is expected to increase significantly since the self-assembly safety door must be necessarily installed in consideration of the safety of users in places where it is dangerous for infants or children and in which safety accidents happen.

[Description of Reference Numerals]

| | |
|---|---|
| 100: self-assembly safety door | 110: corner part |
| 120: door | 130: doorpost |
| 131: first frame | 131a: first doorframe |
| 131b: second doorframe | 132: second frame |
| 132a: third doorframe | 132b: fourth doorframe |

-continued

| [Description of Reference Numerals] | |
|---|---|
| 140: coupling part | 141: fixing member |
| 142: slit groove | 143: first connector |
| 143a: first female connector | 143b: first male connector |
| 143c: first fastener | 144: second connector |
| 144a: second female connector | 144b: second male connector |
| 144c: second fastener | |
| 10: wall body | 11a, 11b: temporary doorframe |
| 111: hinge | |

The invention claimed is:

1. A self-assembly safety door comprising:

a doorpost fixedly coupled to opposite sides of temporary doorframes formed at tips of wall bodies;

a door provided on the doorpost so as to be opened and closed by horizontal rotation;

a corner part provided on one end of the door to be coupled to the door, the corner part being coupled to the doorpost by a hinge to rotate along with the door; and a coupling part interposed between the door and the corner part to couple the door and the corner part, wherein the coupling part comprises:

a fixing member provided at one of the end of the door or an adjacent end of the corner part in a longitudinal direction thereof, a slit groove formed in the other of the end of the door or the adjacent end of the corner part provided with the fixing member such that the fixing member is slidably coupled into the slit groove, a first connector for connecting one upper end of the door to one upper end of the corner part, comprising a first female connector connected to the upper end of the door, a first male connector connected to the upper end of the corner part, and a first fastener to penetrate and couple the first female connector and the first male connector; and a second connector for connecting one lower end of the door to one lower end of the corner part, comprising a second male connector connected to the lower end of the door, a second female connector connected to the lower end of the corner part, and a second fastener to penetrate and couple the second female connector and the second male connector, wherein the doorpost comprises a first frame to which the corner part is rotatably coupled by a hinge, and a second frame arranged in parallel with the first frame while facing the first frame so as to come into contact with the door when the door is closed, wherein the first frame comprises:

a first doorframe coupled to one of the temporary doorframes and having a safety groove formed such that a portion or an entirety of the corner part is selectively inserted into the safety groove during rotation, the first doorframe being elongated in a longitudinal direction of the temporary doorframe; and a second doorframe disposed adjacent to the first doorframe.

2. The self-assembly safety door according to claim 1, wherein the first female connector and the second male connector are disposed on the end of the door so as to be spaced apart from both ends of the fixing member by a predetermined distance.

3. The self-assembly safety door according to claim 1, wherein the second frame comprises:

a third doorframe coupled to the other one of the temporary doorframes and facing the door when the door is closed; and a fourth doorframe disposed adjacent to the third doorframe, and coupled to the other temporary doorframe.

* * * * *